US005513476A

United States Patent [19]

Jones

[11] Patent Number: 5,513,476

[45] Date of Patent: May 7, 1996

[54] RETROFIT FOUNDATION SYSTEM

[75] Inventor: Robert G. Jones, Arcadia, Calif.

[73] Assignee: Harlen Metal Products, Inc., Compton, Calif.

[21] Appl. No.: 17,617

[22] Filed: Feb. 12, 1993

[51] Int. Cl.[6] ..... E04B 1/38

[52] U.S. Cl. ..... 52/713; 52/293.3

[58] Field of Search ..... 52/713, 293.3, 52/303, 294, 712

[56] References Cited

U.S. PATENT DOCUMENTS

| | | | |
|---|---|---|---|
| 2,300,113 | 10/1942 | Faber | 52 X/293.3 |
| 3,939,618 | 2/1976 | Murphy | 52/274 |
| 4,530,194 | 7/1985 | Linton | 52/712 |
| 4,796,403 | 1/1989 | Fulton | 52/713 |
| 4,965,980 | 10/1990 | Leavens | 52/712 |

*Primary Examiner*—Carl D. Friedman

*Assistant Examiner*—Beth A. Aubrey

*Attorney, Agent, or Firm*—Charles H. Schwartz; Ellsworth R. Roston

[57] ABSTRACT

A retrofit foundation system for bolting a sill plate to a foundation including, an upper piece member having a first upper portion for lying against the sill plate for bolting to the side of the sill plate and having a second portion extending outwardly from the side of the sill plate along the top of the foundation and extending past a side wall of the foundation. A lower piece member has a first lower portion for lying against the side of the foundation for bolting to the side of the foundation and has a second portion extending outwardly from the side of the foundation at the top of the foundation and with the outwardly extending portions of the upper piece member and the lower piece member lying adjacent to each other along a plane substantially parallel to the top of the foundation. The outwardly extending portions of the upper and lower piece members are attached together to transfer any external forces from the sill plate to the foundation.

14 Claims, 3 Drawing Sheets

RETROFIT FOUNDATION SYSTEM

BACKGROUND OF THE INVENTION

The present invention relates to a retrofit foundation system and specifically to a system for attaching the bottom portion of structure, such as a structure formed of a wood frame construction, to the foundation.

Before the introduction of seismic building codes, residential and small commercial structures were not required to have the bottom portion of the structure, commonly referred to as the sill plate, bolted to the concrete foundation. For example, in California, homes built before 1949 were not covered by any specific seismic building code, and even after that date many single family dwellings were exempt.

A problem which can occur with buildings which are not bolted to the foundation, and when there is seismic activity, is that the building structure may either move on the foundation or even slip off the foundation. Such movement of the building can thereby cause extensive damage to the building and injury to the occupants. Buildings that have been built after the seismic building codes were introduced, and which were not exempt, have solved these problems through anchor bolts positioned at regular intervals around the perimeter of the building and extending upward from the foundation and passing through complementary openings in the sill plate so as to have the ill plate bolted down to the concrete foundation.

Similarly, the preferred method in retrofitting older structures, which were built before the seismic codes or were exempt, is to add anchor bolts around the perimeter of the building and with the bolts parallel to the outside walls. This is the preferred method since the forces caused by seismic and wind activity are greatest around the perimeter of the building at the outside walls. The anchor bolts, which are either part of the original structure or are retrofit, are normally spaced every four (4) to six (6) feet on center around the perimeter of the building.

The difficulty is that many building structures have 2"×6" joists resting directly on the sill plate to support the flooring for the first floor of the building. This means that there is a very small crawl space underneath the building and only a 6" space between the sill plate and the flooring. With this type of common building arrangement, it is very difficult to retrofit anchor bolts through the sill plate and down into the foundation because of the small spacing. In addition to the above, any other retrofit method of attaching the sill plate to the foundation must accommodate a number of other variations. These variations include the size of the sill plate varying from a nominal 2"×4" to a full size 2"×6", the width of the foundation wall varying from a minimum of 6" up to wider widths such as 8" wide and the positioning of the sill plate on the foundation wall.

There have been a number of prior art attempts to solve the problem of retrofitting an attachment between the sill plate, or other portion of the building construction, to the foundation. One attempt as described above, is to essentially duplicate that which is provided in new building construction. Specifically, anchor bolts are positioned every four (4) to six (6) feet on center around the perimeter and with the anchor bolts passing in an upward direction through the sill plate. In order to accomplish this, a right angle drill has to be used with special bits so as to drill down through the sill plate and into the foundation. The anchor bolts then have to be inserted through the sill plate and into the foundation and locked in place either with mechanical means or by adhesives such as epoxy.

A washer and nut would then be placed over the end of the bolt which protrudes from the sill plate and tightened down to lock the sill plate to the foundation. Although the above is an acceptable procedure, it is expensive and difficult to install and requires highly trained personnel to retrofit such anchor bolts. For example, it can take approximately 45 minutes to install each bolt, and it can be seen that such a period of time for each installed bolt can greatly increase the cost of retrofitting the bolting of the sill plate to the foundation.

Other prior art attempts that have been used include right angle plates and with a top part of the plate overlaying the sill plate and with a perpendicular part of the plate bolted to the concrete foundation. The top part of the plate, which overlays the sill plate, is nailed into position using special tooling and specifically a palm-nailer so as to properly nail the top part of the plate to the sill plate. Typically, palm-nailers are expensive and are normally driven by an air compressor so that it is necessary to drag air lines through the crawl space to drive the palm-nailer.

The major difficulty with the prior art right angle plate structure is strength. Specifically, the right angle plates can straighten out in response to forces moving perpendicular to an outside wall. In addition, there is no blocking against the right angle plate, and the nails driven through the right angle plate and into the top of the sill plate are the only restraint against the outside forces and can also tear up the sill plate. This type of right angle prior art device, therefore, is not as strong as anchor bolts and requires spacing from two (2) to three (3) feet on center to overcome the weaker nature of this type of device. This smaller spacing increases the cost of installation.

Another attempted solution to the retrofit problem is the use of a flat plate with custom blocking between the side of the sill plate and the edge of the foundation. The flat metal plate is then bolted to the side of the foundation and with long lag screws extending through the flat plate, the blocking material and into the sill plate. The difficulty with this type of prior art device is that every piece of blocking must be custom cut in the field to fit the specific distance from the side of the sill plate to the edge of the foundation since there is no standard distance between the side of the sill plate and the edge of the foundation.

Another difficulty with the flat plate device is that the blocking must either be glued or continuously nailed to the sill plate or another shear plane is created to act against the long lag screws. This greatly reduces the ability to transfer the load on the building down to the foundation. This flat plate prior art device, therefore, again, is not as strong as the anchor bolts used in new construction and this type of flat plate device is normally placed at every three (3) to four (4) feet on center, which increases the cost.

Another prior art device, which has been used, does not really address the issue of lateral shear since it is a hold down which resists uplift. This type of hold down device typically extends between the foundation and the joists which are mounted on the sill plate. This type of prior art device does not resolve the problem of retrofitting a frame construction building to resist seismic activity or high winds.

It should be noted that in all of the prior art attempts at retrofitting the locking of the building to the foundation, there does have to be some attachment between the concrete foundation and the frame construction of the building. This means that bolts have to be inserted into the foundation. This requires drilling into the foundation and the insertion and locking of bolts in position around the perimeter of the building. The drilling, insertion and locking of each bolt takes a considerable period of time. Therefore, any retrofit device should be as strong as possible so as to minimize the number of retrofit devices and thereby minimize the number of bolts which must be inserted into the concrete foundation.

For example, if new construction requires anchor bolts to be located every six (6) feet on center, then a retrofit system which requires that the bolts be located closer than six (6) feet on center is not desirable. For example, a retrofit system which requires devices to be two (2) to three (3) feet on center, such as with one prior art device or, three (3) to four (4) feet on center, as with another prior art device, require two (2) to three (3) times as much time and cost to install compared to a retrofit system which requires devices to be located approximately six (6) feet on center. .The present invention is directed towards such a solution wherein the spacing of the retrofit devices is similar to new construction and which is easy to install and is relatively low in cost.

SUMMARY OF INVENTION

The present invention provides for a two part structure which is attached to the side of the sill plate and to the side of the foundation so that no special tools are needed to install the device. The device of the present invention includes two right angle pieces and with standard lag screws used to attach the upper right angle piece to the side of the sill plate. The lower right piece is attached to the side of the concrete foundation using bolts which have been inserted into pre-drilled holes on the side of the foundation. The bolts are held in position by standard means such as mechanical means or adhesive means such as epoxy.

As indicated above, both the upper and lower pieces each have a substantially right angle bend to have a first portion which lies against either the sill plate or foundation and a second portion which extends outwardly from the sill plate or foundation. The outwardly extending portions each include openings to form bolt holes. The upper and lower pieces are aligned in the field with the outwardly extending portions overlaying each other to provide for matching bolt holes. Bolts are passed through the bolt holes in both pieces and are locked by nuts to make a rigid strong structure.

The present invention solves a number of problems with the prior art devices and methods. First, the present invention is inexpensive to produce in large quantities and is easy to install. The easy installation results from the fact that the structure of the present invention requires no special tools or training for installation. The structure of the present invention fits any size sill plate and foundation that typically may be found at a job site. This flexibility is provided because the pattern of bolt holes between the outwardly extending portions of the upper and lower pieces allows for a field adjusted custom connection for virtually any depth of the sill plate relative to any width for the concrete foundation.

Because there is substantially a 90° bend between the upper piece connected to the sill plate and through the lower piece to the foundation, this provides an extremely strong resistance to forces perpendicular to the foundation. The length of the attachment of the outwardly extending portion of the upper piece to the outwardly extending portion of the lower piece is field customized and may provide for the shortest and strongest connection available without the necessity of manufacturing specialized parts for each application. The substantially 90° bend between the outwardly extending portion of the lower piece and the portion attached to the foundation also adds strength to the attachment to efficiently transfer loads to the foundation.

The present invention may provide for essentially the same spacing of six (6) feet on center as new construction while most prior art retrofitting products must be spaced a maximum of three (3) or four (4) feet on center. This can result in a saving of at least 33% to 50% on labor and materials. This is a significant increase in efficiency and a significant reduction in the cost of securing the wood frame structure to the foundation.

DETAILED DESCRIPTION OF THE DRAWINGS

Figure 1:
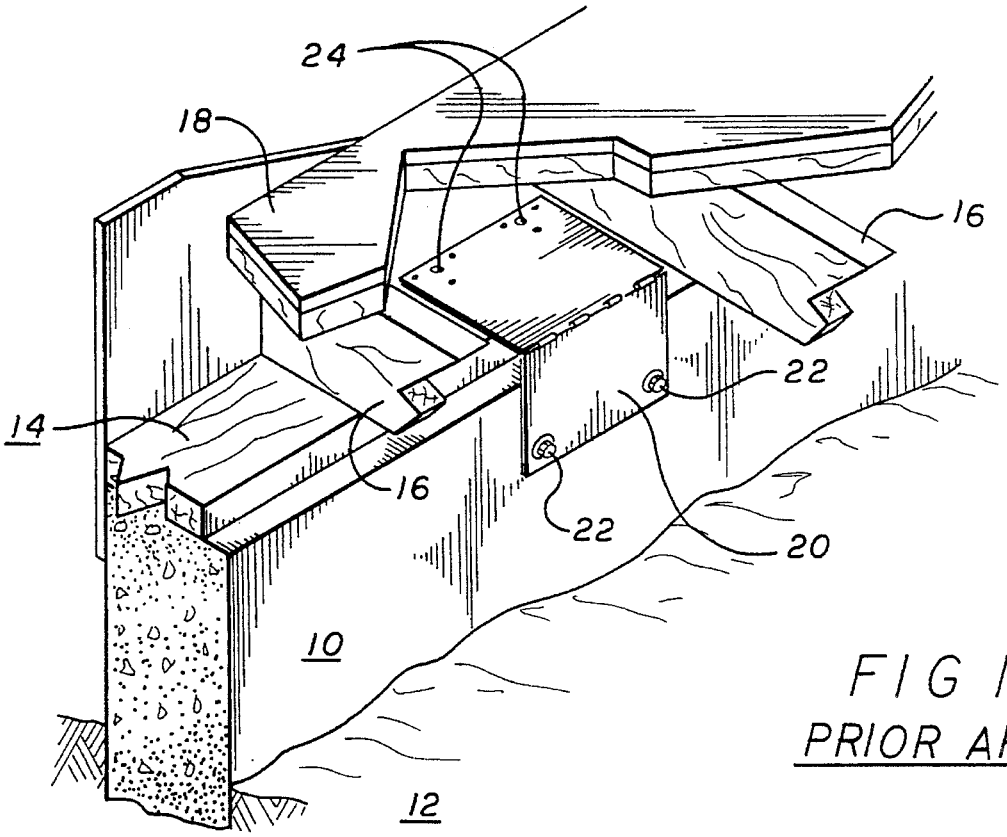
FIG 1 PRIOR ART
FIG. 1 is a perspective view of a typical structure of a sill plate attached to the concrete foundation and showing a first example of a prior art retrofitting device to secure the sill plate to the foundation.

As shown in FIG. 1, a foundation 10 is normally formed of cast concrete and is shown set into the ground 12. The portion of the foundation as shown in FIG. 1 and in the following FIGS. 2–7 is representative of the foundation structure that normally extends around the perimeter of a building and which foundation supports the building framing which extends above.

A sill plate 14 rests on the top of the concrete foundation 10 and again would extend around the perimeter of the building. Typically, joists such as joists 16 rest directly on the sill plate 14 and with the joists supporting flooring 18. The flooring 18 is shown broken away so as to illustrate the prior art retrofitting devices as well as the retrofitting device of the present invention. It can be seen that there is very little crawl space between the ground 12 and the underside of the flooring 18 and even less space between the top of the sill plate 14 and the underside of the flooring 18. Typically, the joists 16 are 2"×6" so that it can be seen that there is only approximately 6" between the top of the sill plate 14 and the underside of the flooring 18. Additionally, the sill plates 14 can range from between 2"×4" to 2"×6" and also different widths may be provided for the concrete foundation 10. This produces a variety of dimensions for the sides of the sill plate 14 relative to the width of the foundation 10.

In new construction, anchor bolts are typically inserted into the foundation 10, to extend upwardly, while the foundations are being cast. The sill plates have corresponding openings to fit over the bolts so that the sill plate 14 is bolted down to the foundation. Typically, the spacing is 6 feet on center around the perimeter of the house. This type of structure is common on houses that have been built after the enactment of seismic codes. However, after the enactment of seismic codes, many single family dwellings were exempt because of their size. Unfortunately, homes and other structures that were built before the introduction of seismic codes, or homes or buildings that were exempt from the seismic codes, can have severe damage, even with moderate seismic activity or with high winds. Since these conditions can cause structures to move on the foundation and even off the foundations, this can cause extensive damage to the structure and injury to occupants.

FIG. 1 illustrates a prior art retrofitting attempt to solve the above problem. In FIG. 1, a right angle plate 20 is shown bolted to the side of the foundation 10 using bolts 22. Additionally, nails 24 are used to nail through openings in the plate 20 down into the sill plate 14. The bolts 22 are inserted into predrilled holes in the foundation 10 and are then either held in place by mechanical means, such as expanding ends, or through the use of adhesive means, such as epoxy.

Part of the difficulty with the prior art device of FIG. 1 is that a special tool must be used to nail the nails 24 into the sill plate. In particular, a palm-nailer must be used and is normally driven by an air compressor. This means that air lines must be dragged through the crawl space to drive the palm-nailer. Another difficulty with the prior art retrofitting device in FIG. 1 is that the right angle bend in plate 20 can straighten out in response to forces moving perpendicular to the foundation 10. This is partially because there is no blocking against the plate 20 between the side of the sill plate 14 and the plate 20. Therefore, the nails 24, into the top of the sill plate 14, are the only restraint against these perpendicular forces. The structure shown in FIG. 1 may fail unless the retrofitting devices are placed much closer together than six feet on center. For example, the retrofitting devices of FIG. 1 may have to be placed as close as two (2) to three (3) feet on center in order to ensure that they will not fail.

The prior art retrofitting device shown in FIG. 1 is therefore labor intensive since the insertion of the bolts 22, into the concrete foundation 10, is time consuming and the closer spacing of the retrofitting devices 20 means that a much larger number of these bolts have to be inserted into the foundation. In addition, the use of the special tooling, such as the palm-nailer, is awkward and difficult to use.

Figure 2:
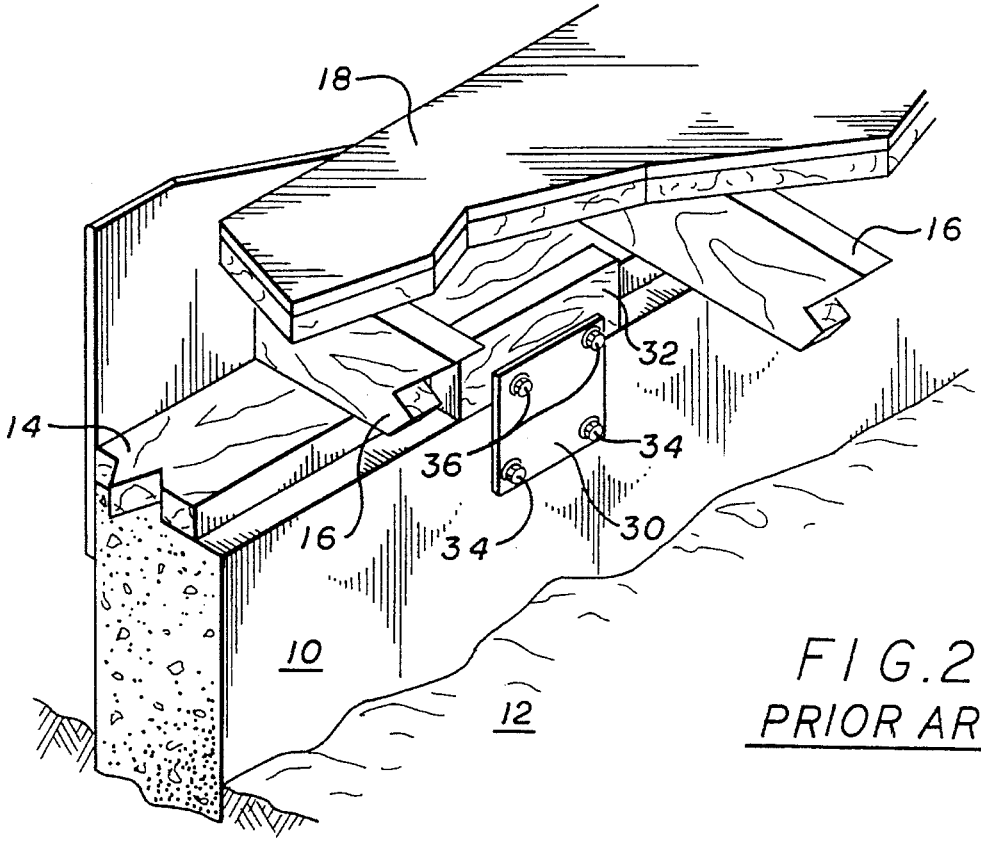
FIG.2 PRIOR ART
FIG. 2 is a perspective view of a second example of a prior art retrofitting device for securing the sill plate to the foundation.

FIG. 2 illustrates a second prior art attempt to retrofit a device to secure the wood framing to the concrete foundation. In FIG. 2, like items are given the same reference numerals as in FIG. 1. As shown in FIG. 2, a flat plate 30 is shown to attach to the side of the foundation 10 and extends upwardly past the top of the foundation 10.

A custom block of wood 32 is inserted between the plate 30 and the side of the sill plate 14. Each piece of blocking 32 must be cut, in the field, to fit the particular distance from the side of the sill plate 14 to the edge of the foundation 10. Since this particular distance may vary within the structure, this type of retrofitting device is also labor intensive since each retrofitting device requires a custom piece of blocking 32.

Bolts 34 are used to attach the bottom of the plate 30 to the side of the foundation 10 in a similar manner to the bolts 22 of FIG. 1. Specifically, these bolts are inserted into predrilled holes which drilling, as indicated above, is labor intensive and with the bolts either held in position by mechanical means or by adhesive means. Long lag screws 36 are passed through openings in the plate 30 through the custom blocking 32 and into the side of the sill plate 14. These lag screws 36 must be quite long since they have to extend not only a sufficient distance into the sill plate 14, but must also extend through the custom blocking 32. The length of the lag screws 32 reduces the transfer of the load to the foundation.

If the blocking 32 is not glued or continuously nailed to the sill plate 14, this creates another shear plane acting against the lag screws 36 which further reduces the ability of the screws to transfer the load down to the foundation. This type of retrofitting device also cannot be spaced at six (6) feet on center and typically must be spaced every three (3) or four (4) feet on center. As indicated above, because of the labor intensive nature of inserting bolts into the foundation 10, the reduction of the spacing to three or four feet on center greatly increases the cost of installation of the prior art retrofitting devices shown in FIG. 2. This is in addition to the fitting of the custom blocking 32.

Figure 3:
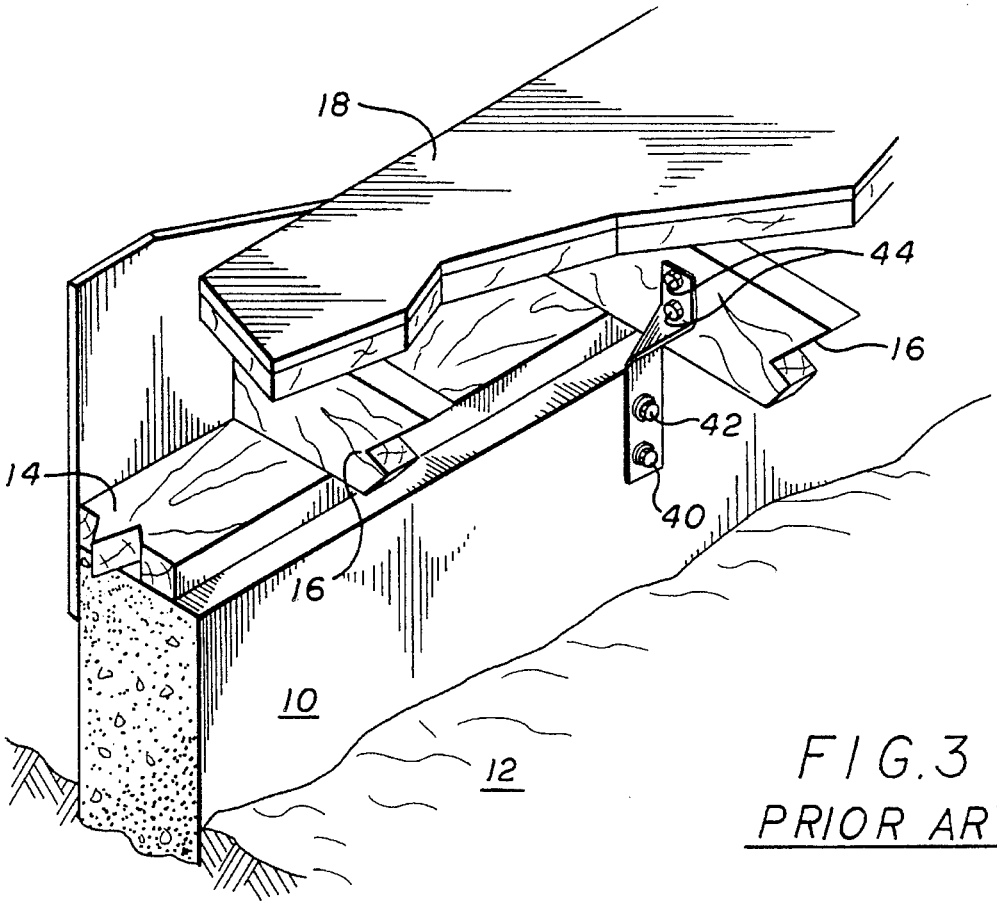
FIG. 3 PRIOR ART
FIG. 3 is a perspective view of a third example of a prior art retrofitting device which only secures the joist to the foundation.
Figure 4:
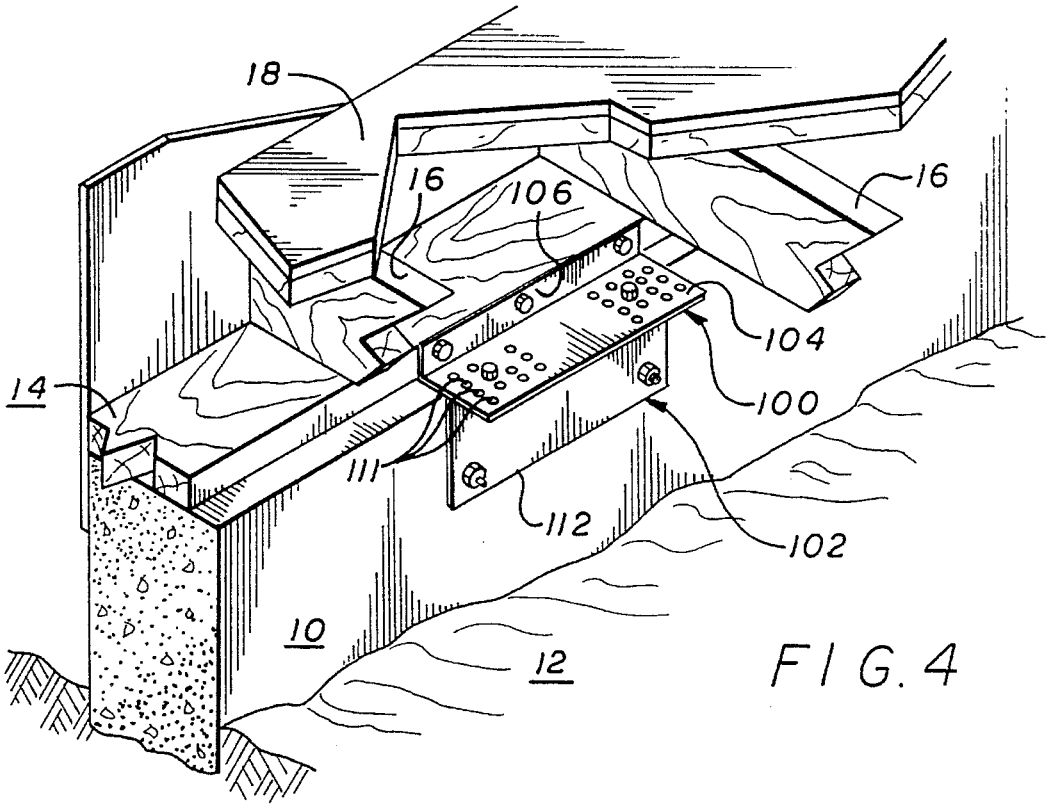
FIG. 4 is a perspective view of the two piece retrofitting device of the present invention for securing the sill piece to the foundation.

FIG. 3 shows yet another prior art retrofitting attempt to secure the wood framing to the foundation. In FIG. 3, a hold down 40 is shown to extend between the side of the foundation 10 and the side of a joist 16. Two bolts 42 attach the strap 40 to the foundation 10 using the predrilled holes in the foundation as indicated above. Lag screws 44 attach the top of the strap 40 to the side of the joist 16. These prior art retrofitting devices 40 do not actually address the problem of lateral shear which occurs with seismic activity or high winds. The device 40, as shown in FIG. 3, is only a hold down which resists uplift and does not address the problem solved by the present invention or attempted to be solved by the prior art structures of FIGS. 1 and 2.

FIGS. 4–8 show a retrofitting device of the present invention as applied to a foundation having either parallel side walls or sloping side walls. As shown in FIGS. 4–7, the foundation 10 is set into the ground 12 and with the sill plate 14 running along the top surface of the foundation 10. The joists 16 are positioned on the sill plate 14 and with flooring 18 positioned on the joists 16. The flooring 18 is shown broken away to illustrate the present invention.

Figure 8:
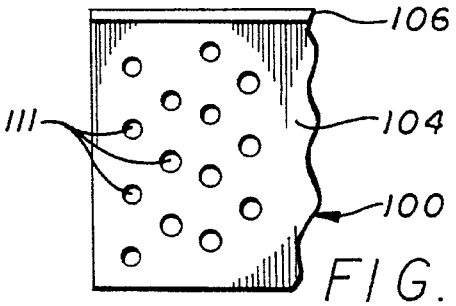
FIG. 8 is a fragmental view of one piece of the present invention illustrating an offset hole arrangement.

As can be seen in FIGS. 4–6 and 8, the retrofitting device of the present invention includes upper and lower plates 100 and 102. Turning first to the upper plate 100, this plate 100 is formed as a right angle piece including an outwardly extending base portion 104 and an upwardly extending portion 106. The upwardly extending portion 106 includes a number of openings 108 used to receive lag screws 110. The base portion 104 has a number of columns of openings 111, alternating between columns of four and columns of three openings 111. Two such groups of columns are shown and with each column of openings 111 slightly offset from the adjacent column, as shown in FIG. 8, so that there is an incremental change in distance from the upwardly extending plate portion 106 to each one of the openings 111 in the different columns.

Figure 5:
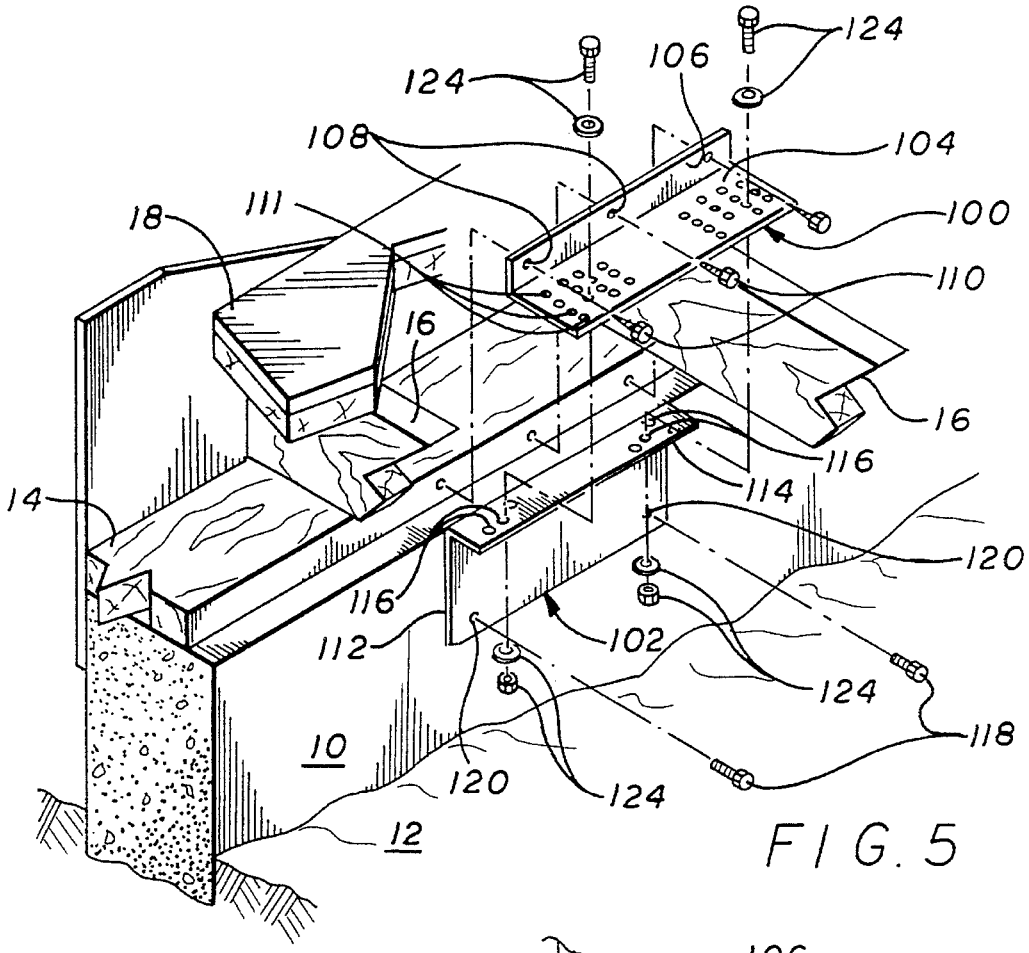
FIG. 5 is an exploded perspective view of the present invention illustrating the various components of the present invention and how they are attached to the sill plate, the foundation and to each other.
Figure 6:
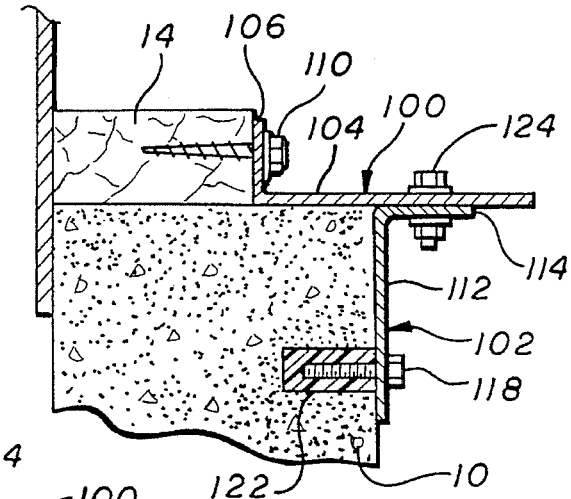
FIG. 6 is a cross sectional view of the retrofitting device of the present invention as used with a foundation having at least one side wall substantially perpendicular to the top of the foundation.
Figure 7:
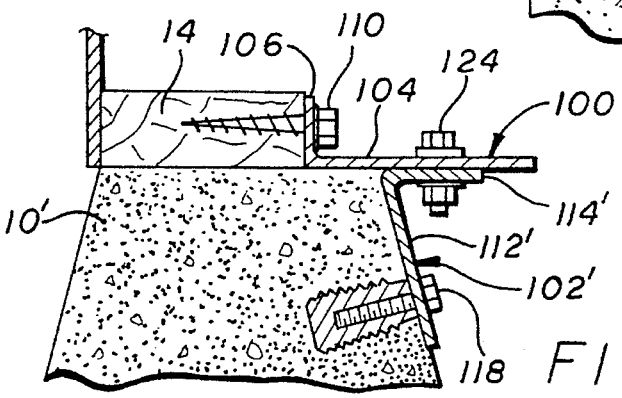
FIG. 7 is a cross sectional view of a modification of the present invention showing its use with the foundation having sloping sides.

The lower plate 102 is also formed as a right angle piece having a first downwardly extending portion 112 to lie against the side of the foundation 10 and an outwardly extending portion 114. The outwardly extending portion 114 includes a plurality of openings 116 which are offset from each other. The openings 116 are in two groups and each opening 116 in each group offset in the direction extending away from the side of the foundation 10. Bolts 118 are used to attach the downwardly extending portion 112 to the side of the foundation 10 using predrilled openings as described above. As shown in FIGS. 5 and 6, the bolts 118 pass through openings 120 in the plate 112 and into predrilled openings 122. The openings 122 may be filled with an adhesive material such as an epoxy as shown in FIG. 6, to lock the bolts 118 in position or a mechanical means may be used as shown in FIG. 7. The final interconnecting between the first and second pieces 100 and 102 are nut, bolt and washer structures 124 which lock the upper piece 100 to the lower piece 102 by passing through the appropriate ones of the openings 111 and 116.

Typically, in the field, one or the other of the pieces 100 and 102 is attached to the appropriate one of the sill plate or the foundation at an accessible position. For example, the upper piece 100 may be attached to the sill plate 14 using the lag screws 110 as shown in the cross sectional view of FIG. 6. The lower piece 102 is then slid against the side of the foundation 10 until one pair of the openings 116, in the lower piece 102, is aligned with one pair of the openings 111 in the upper piece 102. Typically, the openings that align which are closest to the foundation 10 and sill plate 14 are chosen. The upper and lower pieces 100 and 102 are then bolted together using the bolt washer and nut structures 124. The lower piece 102 has either been previously bolted or is then bolted to the side of the foundation using bolts 118 in the openings 122 in the foundation 10.

It is to be appreciated that the above installation procedure could be reversed by installing the lower piece 102 before the upper piece 10 and also by marking the position for the bolts in the foundation 10 so that these positions may be predrilled before the upper and lower pieces are bolted to each other. The preferred method, however, is to install the upper piece 100, first, to the sill plate and then attach the lower piece 102 to the foundation. In any event, the resultant structure is very strong since the 90° bends in the upper and lower pieces, as connected to the sill plate and the foundation, provides an extremely strong resistance to forces perpendicular to the foundation, and adds strength to the connection between the upper and lower pieces so that the loads are transferred down to the foundation instead of being absorbed in the device. It can be seen that the upper and lower pieces are tightly positioned against the sill plate and the foundation so that all of the forces are properly absorbed in the foundation in response to either seismic activity or high winds.

It can be seen that no matter what position the side of the sill plate 14 has relative to the side of the foundation 10, or no matter what width for the sill plate 14 or the foundation 10, there is an appropriate alignment position between the groups of openings 111 and 116. This is because the openings 116 in each group are offset from each other to provide for three different positions relative to the side of the foundation. The openings 111 in the columns of each group are each offset relative to the other so that each opening 111 has a different position relative to the side of the sill plate 14. This combination of offsets for the openings 111 and 116 produces a very large number of incremental distances to accommodate substantially all of the various possibilities in spacing and widths between the sill plate 14 and the foundation 10.

The present invention thereby allows for a field adjusted custom connection for any depth of sill plate and any width foundation. The present invention is relatively inexpensive to produce in large quantities since there is no customizing of the retrofitting hardware and each set of two pieces is the same for any situation. The present invention is also quick to install, requires no special tools or training and is strong so that it may be safely spaced at six feet on center to reduce both labor and materials.

FIG. 7 shows an alternative structure to accommodate foundations such as foundation 10' which has slightly sloping sides. In the alternative structure as shown in FIG. 7, the top piece 100 is essentially identical and the only difference in the bottom piece 102' is that it has a bend of less than 90° between the portions 112' and 114' to accommodate the sloping size of the foundation 10'. This slight change in shape of the bottom piece 102' may either be accomplished in the field by bending the piece 102 of FIG. 6, using a hammer, or such a slightly modified piece 102' may be supplied as an alternative device in geographic areas where houses are typically built with such sloping foundation walls. In any event, the device would operate substantially the same manner as shown in the embodiment in FIGS. 4–6 and 8.

The present invention therefore provides for a two-piece retrofitting device which may be attached to the side of the sill plate and the side of the foundation and requires no special tools to install. Standard lag screws attach the upper piece to the side of the sill plate and the lower piece is attached to the foundation using bolts installed in a standard manner. The upper and bottom pieces are field aligned to each other using offset openings in the upper and lower piece, and with the upper and lower pieces bolted to each other to provide the shortest and strongest connection available to bolt the frame structure to the foundation without customized parts for each application.

Although the present invention has been described with reference to particular embodiments, it is to be appreciated that various adaptations and modifications may be made. For example, in place of a plurality of individual offset openings in the top and bottom pieces, slots positioned at an angle may be provided to allow for an infinite adjustment in position between the upper and lower pieces. The use of such slots is not as strong as the individual openings since shear forces could produce sliding movement along the slots. In any event, it is to be appreciated that the invention is only to be limited by the appended claims.

I claim:

1. A two-piece retrofit foundation device for bolting an existing wood sill plate of a building structure having top, bottom and side walls to an existing foundation of the building structure having top, bottom and side walls to resist seismic or lateral forces and with the bottom wall of the sill plate lying on the top wall of the foundation to form a common plane including, an upper piece member having a first upper portion for lying against a side wall of the sill plate for bolting to the side wall of the sill plate and having a second upper portion to form an outwardly extending portion which extends out from the side wall of the sill plate and lies along the common plane at top wall of the foundation to extend past a side wall of the foundation, a lower piece member having a first lower portion for lying against the side wall of the foundation for bolting to the side wall of the foundation and having a second lower portion to form an outwardly extending portion which extends out from the side wall of the foundation and which lies in the common plane at the top wall of the foundation and with the outwardly extending portions of the upper piece member and the lower piece member lying adjacent to each other along the common plane at the top wall of the foundation; and means for attaching together the outwardly extending portions of the upper and lower piece members so as to transfer any seismic or lateral forces from the sill plate to the foundation.

2. The two-piece retrofit foundation device of claim 1 wherein the upper piece member has the first and second upper portions substantially at right angles to each other and the lower piece member has the first and second lower portions substantially at right angles to each other.

3. The retrofit foundation device of claim 1 wherein the upper piece member has the first and second upper portions substantially at right angles to each other and the lower piece member has the first and second lower portions in an angular relationship in accordance with any slope of the side wall of the foundation.

4. The retrofit foundation device of claim 1 wherein the outwardly extending portions of the upper and lower piece members include openings and with the means for attachment including nut and bolt structures for passing through the openings to bolt the outwardly extending portions together.

5. The retrofit foundation device of claim 4 wherein the outwardly extending portions of the upper and lower piece members include a plurality of openings each offset from the other to provide for incremental distances to accommodate variations in the distance of the edge of the sill plate from the edge of the foundation.

6. The retrofit foundation device of claim 5 wherein the openings in the outward extending portion of the upper piece member are formed in at least one group of a plurality of columns and with the openings in each column equidistant from each other but the openings in each column offset from the openings in the adjacent column.

7. The retrofit foundation device of claim 6 wherein the openings in the outwardly extending portion of the lower piece member are smaller in number than the openings in the outwardly extending portion of the upper piece member.

8. A method of retrofitting the bolting of an existing wood sill plate of a building structure having top, bottom and side walls to an existing foundation of the building structure having top, bottom and side walls to resist seismic or lateral forces and with the bottom wall of the sill plate lying on the top wall of the foundation to form a common plane and including the following steps, providing an upper piece member having a first upper portion lying against a side wall of the sill plate and having a second upper portion to form an outwardly extending portion which extends out from the first upper portion and lies in the common plane along the top wall of the foundation and extends past the side wall of the foundation, providing a lower piece member having a first lower portion lying against the side wall of the foundation and having a second lower portion to form an outwardly extending portion which extends out from the first lower portion and lies in the common plane and having the outwardly extending portions of the upper piece member and the lower piece member lying adjacent to each other along the common plane at the top wall of the foundation;

bolting the appropriate portion of one of the upper or lower piece member to the side wall of the sill plate or foundation, bolting the appropriate portion of the other of the upper or lower piece member to the side wall of the sill plate or foundation, and attaching together the outwardly extending portions of the upper and lower piece members so as to transfer any external seismic or lateral forces from the sill plate to the foundation.

9. The method of claim 8 including the additional steps of providing the upper piece member to have the first and second upper portions substantially at right angles to each other and providing the lower piece member to have the first and second lower portions substantially at right angles to each other.

10. The method of claim 8 including the additional steps of providing the upper piece member to have the first and second upper portions substantially at right angles to each other and providing the lower piece member to have the first and second lower portions in an angular relationship in accordance with any slope of the side wall of the foundation.

11. The method of claim 8 including the additional steps of providing the outwardly extending portions of the upper and lower piece members to include openings and providing nut and bolt structures for passing through the openings and bolting the outwardly extending portions together using the nut and bolt structures.

12. The method of claim 11 including the additional step of providing the outwardly extending portions of the upper and lower piece members to include a plurality of openings each offset from the other to provide for incremental distances to accommodate variations in distance of the edge of the sill plate from the edge of the foundation.

13. The method of claim 12 including the additional steps of forming the openings in the outward extending portion of the upper piece member in at least one group of a plurality of columns forming the openings in each column equidistant from each other but with the openings in each column offset from the openings in the adjacent column.

14. The method of claim 13 including the additional step of providing the openings in the outwardly extending portion of the lower piece member in a number smaller than the openings in the outwardly extending portion of the upper piece member.

* * * * *